US009087467B2

(12) United States Patent
Ootsuka

(10) Patent No.: US 9,087,467 B2
(45) Date of Patent: Jul. 21, 2015

(54) DISPLAY CONTROL DEVICE AND DISPLAY CONTROL METHOD

(75) Inventor: Mai Ootsuka, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 641 days.

(21) Appl. No.: 13/396,239

(22) Filed: Feb. 14, 2012

(65) Prior Publication Data

US 2012/0218180 A1 Aug. 30, 2012

(30) Foreign Application Priority Data

Feb. 24, 2011 (JP) ..... 2011-038114

(51) Int. Cl.
*G09G 5/00* (2006.01)

(52) U.S. Cl.
CPC ..... *G09G 5/00* (2013.01); *G09G 2340/045* (2013.01); *G09G 2354/00* (2013.01)

(58) Field of Classification Search
CPC .. G09G 5/00; G09G 2354/00; G09G 2356/00
USPC ..... 345/19–20, 56, 472.1, 472.2; 359/467; 348/59
See application file for complete search history.

(56) References Cited

U.S. PATENT DOCUMENTS

| | | | | |
|---|---|---|---|---|
| 6,592,223 | B1 * | 7/2003 | Stern et al. | 351/239 |
| 7,375,886 | B2 * | 5/2008 | Lipton et al. | 359/463 |
| 7,924,297 | B2 | 4/2011 | Morikawa et al. | |
| 8,370,744 | B2 * | 2/2013 | Parker et al. | 715/718 |

FOREIGN PATENT DOCUMENTS

| | | |
|---|---|---|
| JP | 2008-042353 | 2/2008 |
| JP | 2008-085461 | 4/2008 |
| JP | 2009-103908 | 5/2009 |

* cited by examiner

*Primary Examiner* — Abbas Abdulselam
(74) *Attorney, Agent, or Firm* — Cowan, Liebowitz & Latman, P.C.

(57) ABSTRACT

A display control device acquires the size of a picture added in advance to picture data and an optimum viewing distance corresponding to the picture. The display control device calculates a viewing distance, in which the relationship between the size of the picture and the optimum viewing distance is equal to the relationship between the display size and the viewing distance, as a recommended viewing distance based on the size of the picture, the optimum viewing distance, and the display size of the picture. Then, the display control device notifies the calculated recommended viewing distance to a user.

8 Claims, 9 Drawing Sheets

FIG. 2A
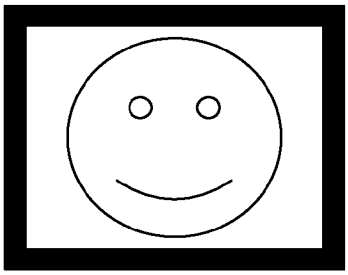
FIG. 2B
| | |
|---|---|
| Picture ID | 001 |
| Work title | A |
| Artist name | B |
| Production year | 1900 |
| Picture size | Transverse : 300cm<br>Longitudinal : 200cm |
| Optimum viewing distance | 400cm |
| ... | ... |
FIG. 3
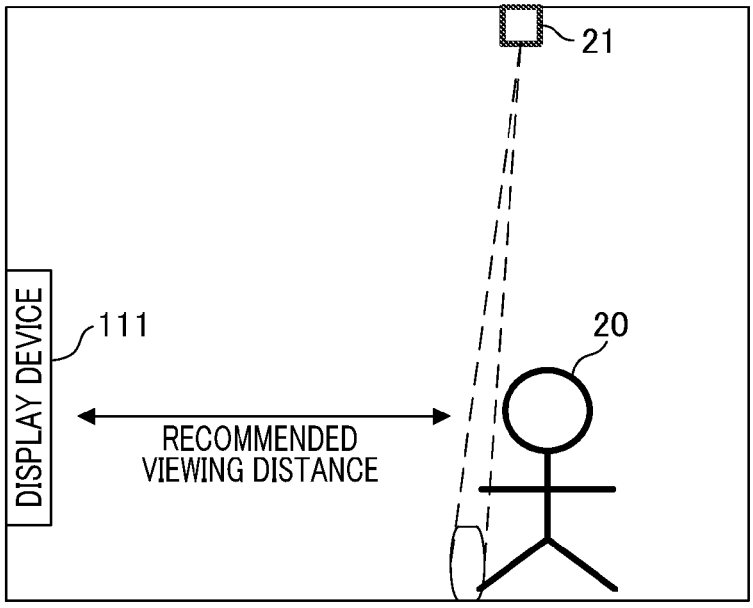

DISPLAY CONTROL DEVICE AND DISPLAY CONTROL METHOD

BACKGROUND OF THE INVENTION

1. Field of the Invention

The present invention relates to a display control device and a display control method.

2. Description of the Related Art

In recent years, there have been an increasing number of cases in which a viewer views digitized pictures using a display control device including a display or the like at an electronic museum or a home. When a viewer views the pictures using the display control device, the sizes of the pictures vary depending on works. In many cases, the size of the picture does not match the size of the display. Thus, the display control device often displays picture data on the display in an enlarged or reduced size.

On the other hand, each picture has a viewing distance (optimum viewing distance) best suited according to the artist's intension. The optimum viewing distance is a unique viewing distance unique to the picture. The optimum viewing distance corresponding to each picture varies depending on works. If a viewer does not view a picture at the optimum viewing distance corresponding thereto, a viewer may not see what the artist intends. Thus, in order for a viewer to be able to view a picture on a display in the most preferred state where the artist's intention has been reproduced, it is contemplated that optimum viewing distance information is added to picture data in advance.

However, since an optimum viewing distance for viewing a picture on a display differs depending on works and the size of the display, the optimum viewing distance may not be uniquely determined depending on the size of the display. Also, since an optimum viewing distance may also vary each time the picture is switched, a viewer may not know how far the viewing distance is applied to each picture. In other words, when viewing a picture on a display, the reproduction of the same condition as that in which an actual picture is viewed from the optimum viewing distance is required.

Japanese Patent Laid-Open No. 2008-042353 discloses a visible image display device that changes the distance for limiting the viewing of a picture depending on the resolution of the screen size and the visible image. Also, Japanese Patent Laid-Open No. 2008-085461 discloses a display control device that displays a visible image by scaling a visible image signal depending on the amount of change in resolution and the viewing distance when the resolution of the visible image has been switched. Further, Japanese Patent Laid-Open No. 2009-103908 discloses an image display device that calculates an optimum viewing distance based on the size of a screen and calculates the size of an image having the same visual field as that obtained at a time of image capture when the image is displayed on the display device to thereby cut out the captured image based on the calculated image size and output it to the display device.

However, any one of the aforementioned technologies disclosed in Japanese Patent Laid-Open No. 2008-042353, Japanese Patent Laid-Open No. 2008-085461, and Japanese Patent Laid-Open No. 2009-103908 does not calculate a viewing distance in which the relationship between the size of a picture and the optimum viewing distance unique to the picture is equal to the relationship between the display size and the viewing distance. In addition, any one of the aforementioned technologies does not calculate a display size in which the relationship between the size of a picture and the optimum viewing distance thereto is equal to the relationship between the viewing distance and the display size. Thus, when a viewer views a picture displayed on a display device, the viewer cannot view the picture in a way equal to the case in which the actual picture is viewed from the optimum viewing distance unique to the picture using any one of the aforementioned technologies disclosed in Japanese Patent Laid-Open No. 2008-042353, Japanese Patent Laid-Open No. 2008-085461, and Japanese Patent Laid-Open No. 2009-103908.

SUMMARY OF THE INVENTION

The display control device of the present invention enables a viewer to view a picture displayed on a display device more like the way in which the viewer views an actual picture from the optimum viewing distance unique to the picture.

According to an aspect of the present invention, a display control device is provided that includes an acquisition unit configured to acquire the size of a picture added in advance to picture data and a unique viewing distance corresponding to the picture; a display size management unit configured to manage the display size of the picture displayed by a display device; a viewing distance calculation unit configured to calculate a recommended viewing distance when a viewer views the picture displayed by the display device based on the size of the picture and the unique viewing distance both acquired by the acquisition unit and the display size of the picture managed by the display size management unit; and a notification unit configured to notify the recommended viewing distance, wherein the viewing distance calculation unit calculates a viewing distance, in which the relationship between the size of the picture and the unique viewing distance is substantially equal to the relationship between the display size and the viewing distance, as the recommended viewing distance.

Further features of the present invention will become apparent from the following description of exemplary embodiments with reference to the attached drawings.

BRIEF DESCRIPTION OF THE DRAWINGS

FIG. 2A is a diagram illustrating an example of a picture.

FIG. 2B is a diagram illustrating an example of picture data corresponding to the picture shown in FIG. 2A.

FIG. 3 is a diagram illustrating an example of a recommended viewing distance notification method.

DESCRIPTION OF THE EMBODIMENTS (First Embodiment)

Figure 1A:
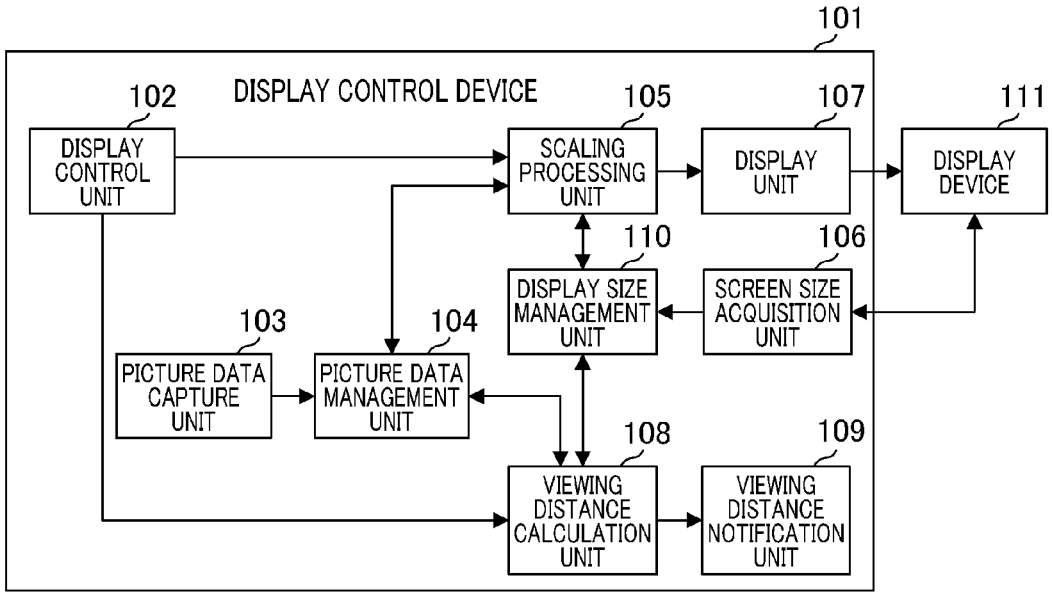
FIG. 1A is a diagram illustrating the general configuration of a display control device according to a first embodiment.
Figure 1B:
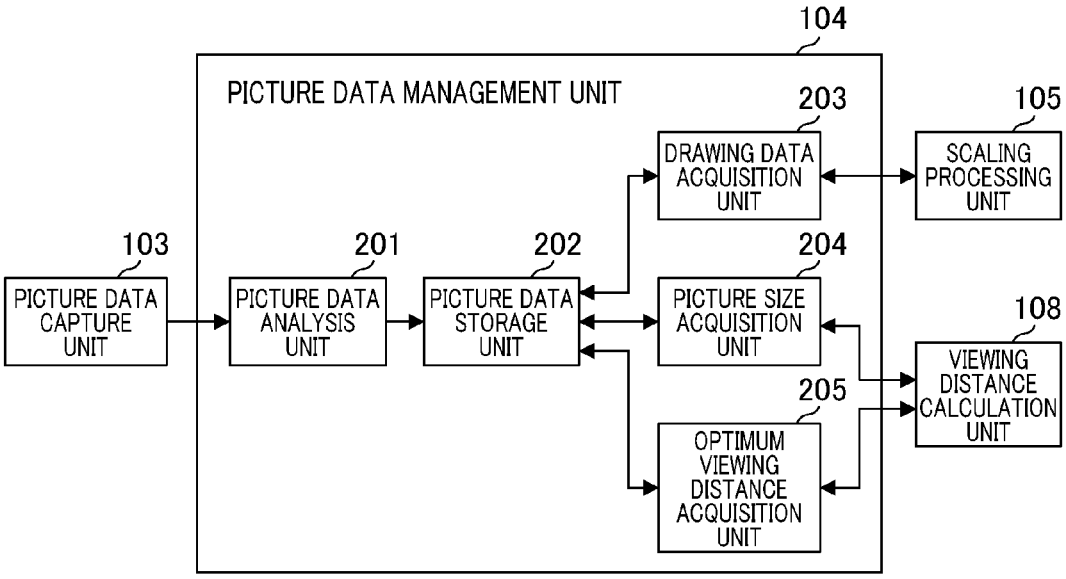
FIG. 1B is a diagram illustrating an example of a configuration of a picture data management unit.

Each of FIGS. 1A and 1B is a diagram illustrating the configuration of a display control device according to a first embodiment of the present invention. FIG. 1A shows the general configuration of a display control device 101. The display control device 101 includes a display control unit 102, a picture data capture unit 103, a picture data management unit 104, a scaling processing unit 105, and a screen size acquisition unit 106. The display control device 101 further includes a display unit 107, a viewing distance calculation unit 108, a viewing distance notification unit 109, and a display size management unit 110.

The display control unit 102 determines picture data to be displayed and controls displaying the picture data in accordance with an instruction given by a user (for example, viewer) or a preset display schedule. The display control unit 102 selects a picture to be displayed, and instructs the scaling processing unit 105 to display the picture. The display control unit 102 notifies, for example, information for specifying a picture to be displayed (for example, picture ID) to the scaling processing unit 105. Also, the display control unit 102 notifies information for specifying a picture to be displayed (for example, picture ID) to the viewing distance calculation unit 108, and instructs the viewing distance calculation unit 108 to calculate a recommended viewing distance.

The picture data capture unit 103 captures picture data. The picture data capture unit 103 may capture picture data from a storage medium such as a USB memory or the like, or may also capture picture data from a picture server or the like via a network. The picture data management unit 104 manages picture data captured by the picture data capture unit 103.

FIG. 1B is a diagram illustrating an example of a configuration of a picture data management unit. The picture data management unit 104 includes a picture data analysis unit 201, a picture data storage unit 202, a image data acquisition unit 203, a picture size acquisition unit 204, and an optimum viewing distance acquisition unit 205.

The picture data analysis unit 201 analyzes metadata added in advance to the picture data captured by the picture data capture unit 103. Metadata includes an optimum viewing distance for a picture, which corresponds to at least the picture data. The optimum viewing distance is a viewing distance (unique viewing distance) unique to the picture. The picture data analysis unit 201 transmits picture data (image data and metadata) after metadata analysis to the picture data storage unit 202. The picture data storage unit 202 stores the picture data received from the picture data analysis unit 201.

Each of FIGS. 2A and 2B is a diagram illustrating an example of picture data to be stored in a picture data storage unit. FIG. 2A shows an example of a picture. Also, FIG. 2B shows an example of picture data corresponding to the picture shown in FIG. 2A. The picture data shown in FIG. 2B includes picture ID, work title, artist name, production year, picture size, optimum viewing distance, and the like.

The picture ID is identification information about picture data. The work title is the work title of a picture corresponding to picture data. The production year is the production year of the picture. The picture size is the size of the picture (the size of the actual picture). The picture size has a picture size in the transverse direction: PW (cm) and a picture size in the longitudinal direction: PH (cm). The optimum viewing distance: BL (cm) is an optimum viewing distance unique to the picture.

Referring back to FIG. 1B, the image data acquisition unit 203 acquires image data for the specified picture from the picture data storage unit 202 in accordance with the instruction given by the scaling processing unit 105, and transmits the acquired image data to the scaling processing unit 105. The picture size acquisition unit 204 acquires the picture size of the specified picture from the picture data storage unit 202 in accordance with the instruction given by the viewing distance calculation unit 108, and transmits the acquired picture size to the viewing distance calculation unit 108. The optimum viewing distance acquisition unit 205 acquires the optimum viewing distance for the specified picture from the picture data storage unit 202 in accordance with the instruction given by the viewing distance calculation unit 108, and transmits acquired optimum viewing distance to the viewing distance calculation unit 108.

Referring back to FIG. 1A, the screen size acquisition unit 106 acquires the screen size of a display device 111 from the display device 111. For example, the screen size acquisition unit 106 automatically acquires the screen size using EDID of an HDMI from the display device 111, where HDMI is an abbreviation for High-Definition Multimedia Interface and EDID is an abbreviation for Extended Display Identification Data. The screen size acquisition unit 106 may store the screen size in advance. The screen size has a screen size in the transverse direction: MW (cm) and a screen size in the longitudinal direction: MH (cm).

The display size management unit 110 manages the display size of picture data. More specifically, the display size management unit 110 acquires the screen size from the screen size acquisition unit 106 and manages the acquired screen size as the display size, and passes the display size to the scaling processing unit 105. The scaling processing unit 105 acquires image data of a picture from the picture data management unit 104 in accordance with the instruction given by the display control unit 102. Also, the scaling processing unit 105 acquires the screen size of the display device 111 from the display size management unit 110. Note that the scaling processing unit 105 may acquire the screen size directly from the screen size acquisition unit 106.

The scaling processing unit 105 performs scaling processing for image data in synchrony with the acquired screen size, and transmits the scaled image data to the display unit 107. The display unit 107 instructs the display device 111 to display image data, and the display device 111 displays a picture. The display device 111 may be a display device such as a liquid crystal display, plasma display, or the like or may also be a display device such as a liquid crystal projector or the like.

The viewing distance calculation unit 108 functions as an acquisition unit that acquires the picture size added in advance to picture data and an optimum viewing distance corresponding to the picture from the picture data management unit 104 in accordance with the instruction given by the display control unit 102. Also, the viewing distance calculation unit 108 acquires the screen size from the display size management unit 110. Note that the viewing distance calculation unit 108 may acquire the screen size directly from the screen size acquisition unit 106.

The viewing distance calculation unit 108 calculates a recommended viewing distance based on the picture size, the optimum viewing distance, and the screen size. The recommended viewing distance is a viewing distance (a distance between the display screen of the display device 111 and a viewer) when a viewer views a picture displayed by the display device 111. More specifically, the viewing distance calculation unit 108 calculates a viewing distance in which the relationship between the picture size and the optimum viewing distance is equal to the relationship between the screen size and the viewing distance as a recommended viewing distance. The viewing distance notification unit 109 functions as a notification unit and notifies the calculated recommended viewing distance calculated by the viewing distance calculation unit 108 to a user. The viewing distance notification unit 109 may also notify a position corresponding to the recommended viewing distance to a user.

FIG. 3 is a diagram illustrating an example of a recommended viewing distance notification method. In the example shown in FIG. 3, the viewing distance notification unit 109 illuminates the floor at a position from the display device 111 which is displaying a picture by a recommended viewing distance as the recommended viewing position by means of a light 21. In this manner, a user 20 can learn a recommended foot placement when viewing the picture. The viewing distance notification unit 109 may also notify a recommended viewing distance to a user using any notification method other than the notification method described with reference to FIG. 3. For example, the viewing distance notification unit 109 may display a recommended viewing distance using a display image or a sound, or may lead a user to a recommended viewing position.

Figure 4:
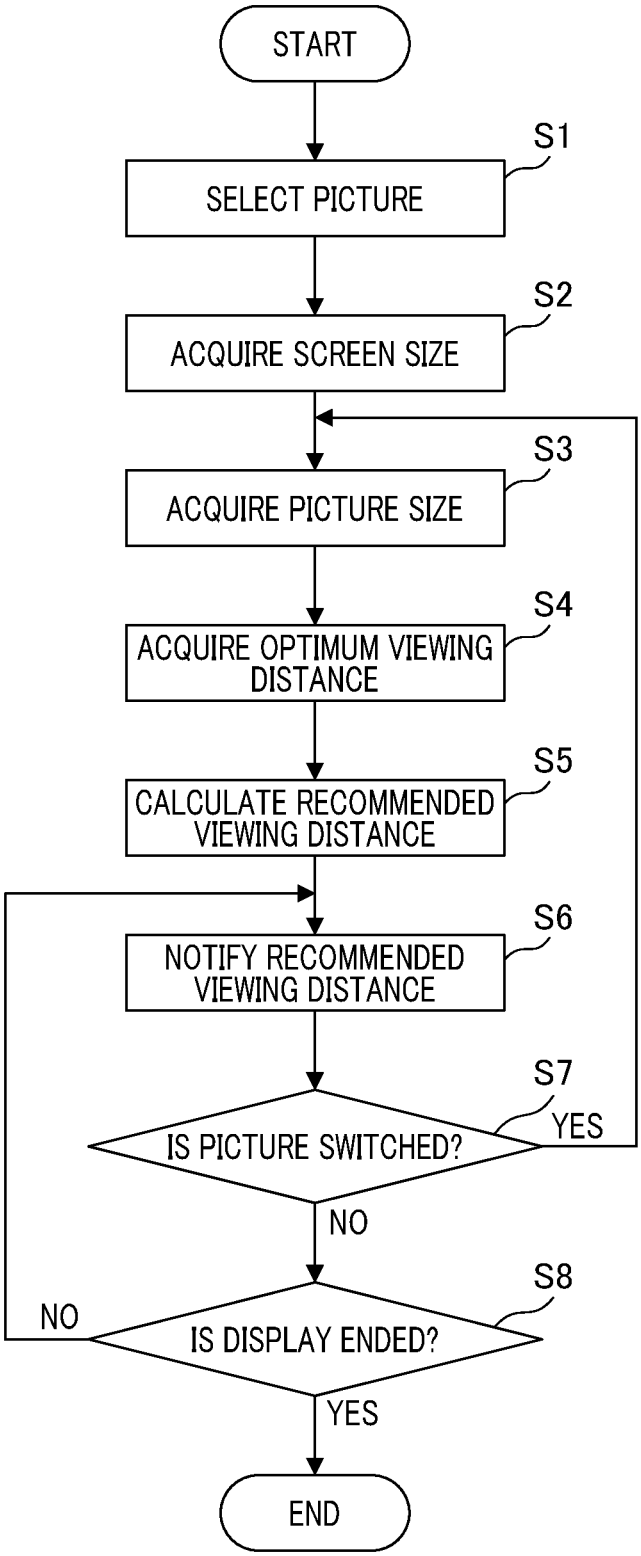
FIG. 4 is a diagram illustrating an example of operation processing performed by the display control device of the first embodiment.

FIG. 4 is a flowchart illustrating an example of operation processing performed by the display control device of the first embodiment. First, the display control unit 102 selects a picture to be displayed, and notifies the selected picture to the viewing distance calculation unit 108 (step S1). More specifically, the display control unit 102 notifies the picture ID of the selected picture to the viewing distance calculation unit 108.

Next, the viewing distance calculation unit 108 acquires the screen size of the display device 111 from the display size management unit 110 (step S2). Also, the viewing distance calculation unit 108 acquires the picture size of a picture, which has been notified from the display control unit 102, from the picture data management unit 104 (step S3). More specifically, the viewing distance calculation unit 108 requests the picture size acquisition unit 204 of the picture data management unit 104 to acquire a picture size corresponding to the picture ID of the notified picture. The picture size acquisition unit 204 acquires the picture size corresponding to the picture ID from the picture data storage unit 202, and passes the acquired picture size to the viewing distance calculation unit 108.

Also, the viewing distance calculation unit 108 acquires the optimum viewing distance for the picture, which has been notified from the display control unit 102, from the picture data management unit 104 (step S4). More specifically, the viewing distance calculation unit 108 requests the optimum viewing distance acquisition unit 205 of the picture data management unit 104 to acquire a picture size corresponding to the picture ID of the notified picture. The optimum viewing distance acquisition unit 205 acquires the optimum viewing distance corresponding to the picture ID from the picture data storage unit 202, and passes the acquired optimum viewing distance to the viewing distance calculation unit 108.

Next, the viewing distance calculation unit 108 calculates a recommended viewing distance based on the screen size acquired in step S2, the picture size acquired in step S3, and the optimum viewing distance for a picture acquired in step S4 (step S5).

Hereinafter, a specific description will be given of an example of calculation of a recommended viewing distance in step S5. In this example, a screen size in the transverse direction is described as "MW", and a screen size in the longitudinal direction is described as "MH". Also, a picture size in the transverse direction is described as "PW", and a picture size in the longitudinal direction is described as "PH". Further, an optimum viewing distance is described as "BL", and a recommended viewing distance is described as "RL".

The viewing distance calculation unit 108 calculates a recommended viewing distance such that the relationship (ratio) between the picture size and the optimum viewing distance is equal to the relationship between the screen size and the recommended viewing distance. More specifically, the viewing distance calculation unit 108 calculates the recommended viewing distance RL based on the following Formula 1:

$$PW:BL=MW:RL$$

$$RL=(MW/PW)\times BL \qquad \text{Formula 1}$$

The viewing distance calculation unit 108 may calculate the recommended viewing distance RL based on the following Formula 2:

$$PH:BL=MH:RL$$

$$RL=(MH/PH)\times BL \qquad \text{Formula 2}$$

Figure 5A:
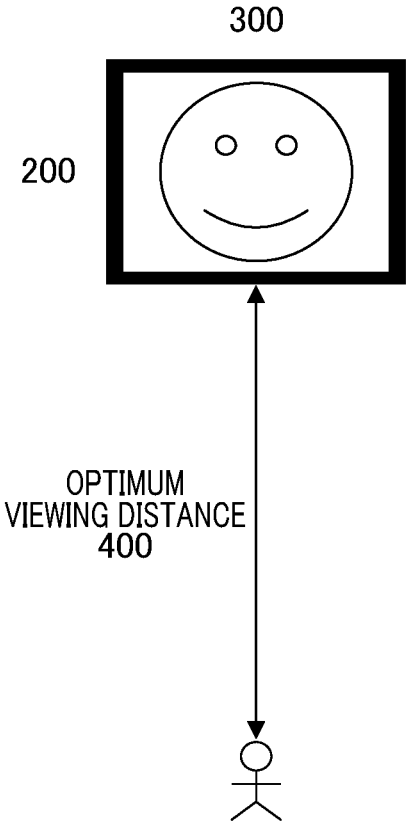
FIG. 5A is a diagram illustrating an example of the relationship between a picture A and an optimum viewing distance.
Figure 5B:
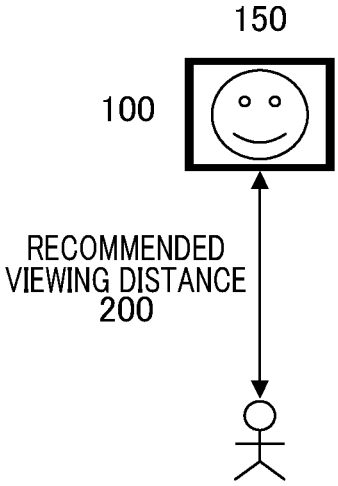
FIG. 5B is a diagram illustrating an example of the relationship between a screen size and a recommended viewing distance RL.

Each of FIGS. 5A and 5B is a diagram illustrating a specific example of calculation for a recommended viewing distance according to the first embodiment. FIG. 5A shows an example of the relationship between the picture A and the optimum viewing distance. PW of the acquired picture A is 300 (cm), and PH of the same is 200 (cm). Also, the optimum viewing distance BL for the acquired picture A is 400 (cm).

Here, the screen size MW in the transverse direction of the acquired picture A is 150 (cm), and the screen size MH in the longitudinal direction of the same is 100 (cm). The viewing distance calculation unit 108 calculates, for example, the recommended viewing distance RL as follows based on the aforementioned Formula 2:

$$RL=(100/200)\times 400=200\ (\text{cm})$$

FIG. 5B shows an example of the relationship between the screen size and the recommended viewing distance RL. When the screen size MW in the transverse direction of a display device for displaying the picture A is 150 (cm) and the screen size MH in the longitudinal direction of the same is 100 (cm), the recommended viewing distance RL is 200 (cm) as described with reference to FIG. 5A.

In the present embodiment, when the screen size is smaller than the actual picture size, the scaling processing unit 105 scales (reduces) the picture data in synchrony with the screen size. However, when the screen size is larger than the picture size, there is no need to display the picture in a scaled (expanded) manner in synchrony with the screen size.

For example, when the screen size is larger than the picture size, the display size management unit 110 may determine the display size equal to the picture size, and the scaling processing unit 105 may instruct the display unit 107 to display the picture in the display size. For example, the display size equal to the picture size may be the same as the picture size or may be larger than the picture size by any dimension. In this case, the recommended viewing distance is calculated as follows. The viewing distance calculation unit 108 acquires the display size equal to the picture size from the display size management unit 110. The viewing distance calculation unit 108 defines the size in the transverse direction of the acquired display size as MW and the size in the longitudinal direction thereof as MH to thereby calculate the recommended viewing distance RL using Formula 1 or Formula 2. In this manner, the recommended viewing distance RL, which is calculated using the display size equal to the picture size, is equal to the optimum viewing distance.

In the example shown in FIG. 5, the aspect ratio of the picture size is the same as the aspect ratio of the screen size. If the aspect ratio of the picture size is different from the aspect ratio of the screen size, the display size management unit 110, for example, determines the display size such that a margin is made in the longitudinal direction or the transverse direction. The viewing distance calculation unit 108 defines the size in the transverse direction of the display size as MW and the size in the longitudinal direction thereof as MH to thereby calculate the recommended viewing distance RL using Formula 1 or Formula 2. Note that a user may set a display size and the viewing distance calculation unit 108 may calculate the recommended viewing distance RL using the set display size. Also, a user may set a picture size or an optimum viewing distance and the viewing distance calculation unit 108 may calculate the recommended viewing distance RL using the set picture size or the set optimum viewing distance.

When a plurality of optimum viewing distances has been added to picture data, the viewing distance calculation unit 108 may calculate a plurality of recommended viewing distances using a plurality of optimum viewing distances added to the picture data.

Referring back to FIG. 4, the viewing distance notification unit 109 notifies the recommended viewing distance calculated in step S5 to a user (step S6). When the viewing distance calculation unit 108 has calculated a plurality of recommended viewing distances, the viewing distance notification unit 109 may notify a plurality of the calculated recommended viewing distances or a recommended viewing distance selected from the plurality of recommended viewing distances to a user. Then, the display control unit 102 determines whether or not a picture to be displayed can be switched (step S7). When a picture to be displayed can be switched, the process returns to step S3. When a picture to be displayed cannot be switched, the process advances to step S8.

In step S8, the display control unit 102 determines whether or not picture display processing is ended (step S8). When the display control unit 102 has determined that picture display processing is not ended, the process advances to step S7. When the display control unit 102 has determined that picture display processing is ended, the process is ended.

The display control device of the first embodiment calculates a recommended viewing distance such that the relationship between the picture size and the optimum viewing distance is equal to the relationship between the screen size and the recommended viewing distance, and notifies the recommended viewing distance to a user. Thus, the display control device of the first embodiment enables a viewer to view a picture displayed on a display device more like the way in which the viewer views an actual picture from the optimum viewing distance unique to the picture.

(Second Embodiment)

Figure 6:
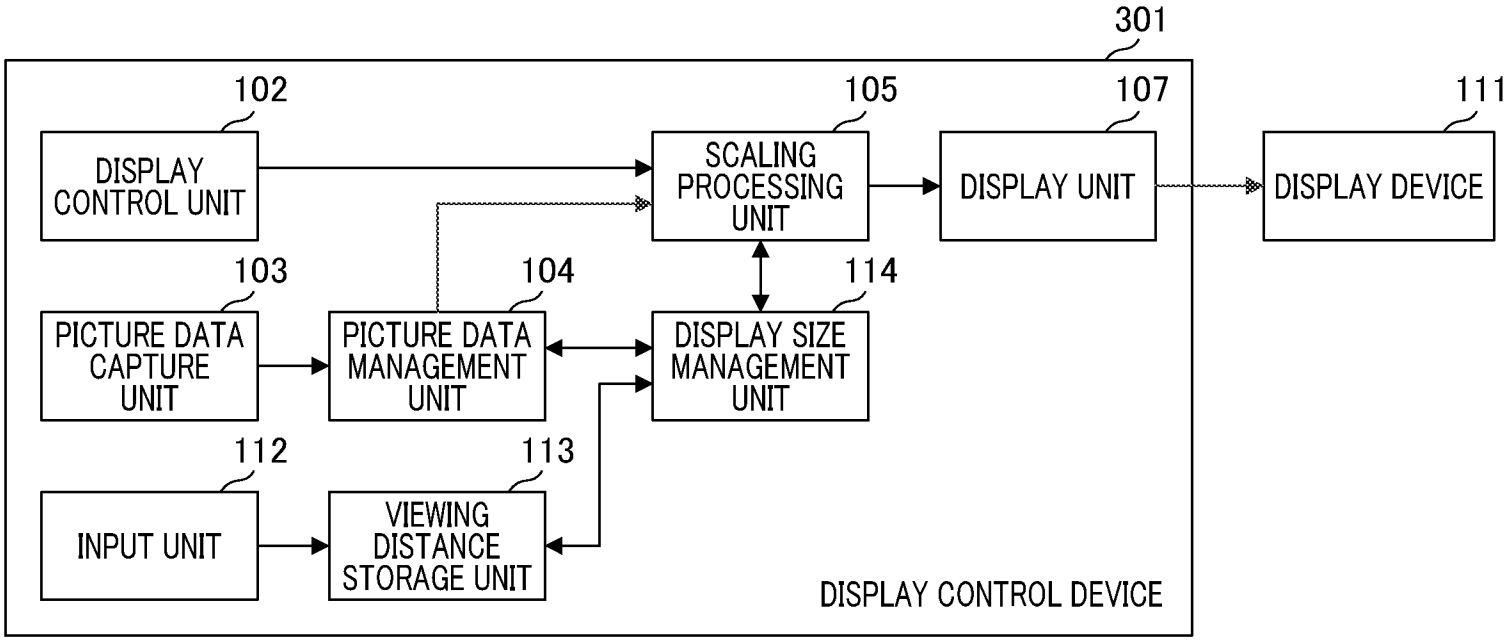
FIG. 6 is a diagram illustrating the configuration of a display control device according to a second embodiment.

FIG. 6 is a diagram illustrating the configuration of a display control device of a second embodiment. A display control device 301 includes the display control unit 102, the picture data capture unit 103, the picture data management unit 104, the scaling processing unit 105, the display unit 107, an input unit 112, a viewing distance storage unit 113, and a display size management unit 114. Among the processing units included in the display control device 301, the processing units designated by the same reference numerals as the processing units included in the display control device 101 shown in FIG. 1A are the same as the processing units included in the display control device 101.

In the present embodiment, when a user installs the display device 111 so as to implement picture viewing, a user is intended to have determined in advance the foot placement for a viewer who views a picture while taking the size of an installation room, obstacles, or the like into consideration. A user performs an input operation for inputting a distance between the display device 111 and a viewer as a viewing distance. The input unit 112 functions as a viewing distance input unit, and inputs a viewing distance in accordance with a user's operation. The viewing distance storage unit 113 stores the viewing distance input by the input unit 112.

The display size management unit 114 acquires the picture ID of a picture to be displayed from the scaling processing unit 105 in accordance with control by the display control unit 102. The display size management unit 114 acquires the picture size and the optimum viewing distance corresponding to the picture ID from the picture data management unit 104. Also, the display size management unit 114 acquires a viewing distance from the viewing distance storage unit 113.

The display size management unit 114 functions as a display size calculation unit that calculates the display size of a picture to be displayed by the display device 111 based on the picture size and the optimum viewing distance both acquired from the picture data management unit 104 and the viewing distance acquired from the viewing distance storage unit 113. More specifically, the display size management unit 114 calculates a display size such that the relationship between the picture size and the optimum viewing distance is equal to the relationship between the viewing distance and the display size. The display size management unit 114 notifies the calculated display size to the scaling processing unit 105.

The scaling processing unit 105 acquires image data for a picture to be displayed from the picture data management unit 104. The scaling processing unit 105 performs scaling processing for the acquired image data such that the acquired image data is scaled in the display size notified from the display size management unit 114, and displays the picture on the display device 111 via the display unit 107.

Hereinafter, a description will be given of an example of calculation of a display size by the display size management unit 114. In this example, a display size in the transverse direction is described as "MW", and a display size in the longitudinal direction is described as "MH". Also, a picture size in the transverse direction is described as "PW", and a picture size in the longitudinal direction is described as "PH". Further, an optimum viewing distance is described as "BL". Additionally, a viewing distance acquired from the viewing distance storage unit 113 by the display size management unit 114 is described as "WL".

The display size management unit 114 calculates a display size such that the relationship (ratio) between the picture size and the optimum viewing distance is equal to the relationship between the display size and the viewing distance. More specifically, the display size management unit 114 calculates MW based on the following Formula 3:

$$PW:BL=MW:WL$$

$$MW=(WL/BL)\times PW \qquad \text{Formula 3}$$

Also, the display size management unit 114 calculates MH based on the following Formula 4:

$$PH:BL=MH:WL$$

$$MH=(WL/BL)\times PH \quad \text{Formula 4}$$

Figure 7A:
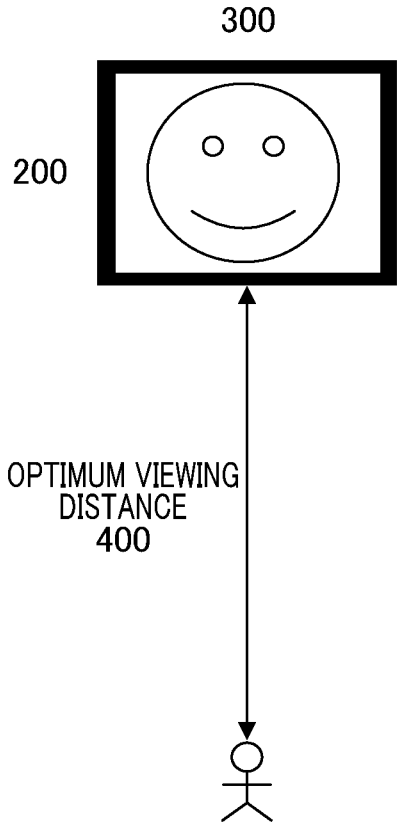
FIG. 7A is a diagram illustrating an example of the relationship between the picture A and the optimum viewing distance.
Figure 7B:
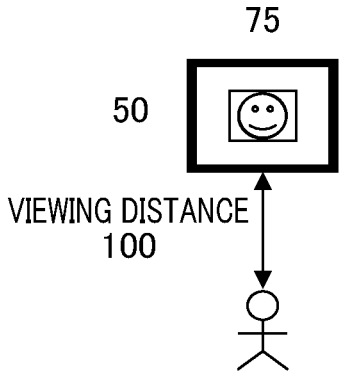
FIG. 7B is a diagram illustrating an example of the relationship between a viewing distance and the calculated display size.

Each of FIGS. 7A and 7B is a diagram illustrating a specific example of calculation for a viewing distance according to the second embodiment. FIG. 7A shows an example of the relationship between the picture A and the optimum viewing distance. PW of the acquired picture A is 300 (cm), and PH of the same is 200 (cm). Also, the optimum viewing distance BL for the acquired picture A is 400 (cm). Here, the viewing distance WL acquired from the viewing distance storage unit 113 by the display size management unit 114 is assumed to be 100 (cm). The display size management unit 114 calculates the display size MW in the transverse direction as follows based on Formula 3:

$$MW=(100/400)\times 300=75 \text{ (cm)}$$

Also, the display size management unit 114 calculates the display size MH in the longitudinal direction as follows based on Formula 4:

$$MH=(100/400)\times 200=50 \text{ (cm)}$$

FIG. 7B shows an example of the relationship between the viewing distance and the calculated display size. As described with reference to FIG. 7A, the display size management unit 114 calculates MW=75 (cm) and MH=50 (cm) as the display size of the picture A. The display device 111 displays the picture A in the calculated display size.

Note that, when the display size calculated by the display size management unit 114 becomes larger than the displayable size on the display device 111, the display size management unit 114 may notify the information to a user. In this case, the display size management unit 114 may instruct the scaling processing unit 105 to control scaling such that an image is displayed in a displayable size. When a projector is used as the display device 111, a predetermined processing unit included in the display device 111 may control the display size instead of the scaling processing unit 105 by controlling the zoom magnification of the projector lens.

The display control device of the second embodiment calculates a display size such that the relationship between the picture size and the optimum viewing distance is equal to the relationship between the display size and the viewing distance, and displays the picture in the calculated display size on the display device. Thus, the display control device of the second embodiment enables a viewer to view a picture displayed on a display device more like the way in which the viewer views an actual picture from the optimum viewing distance unique to the picture.

(Third Embodiment)

Figure 8:
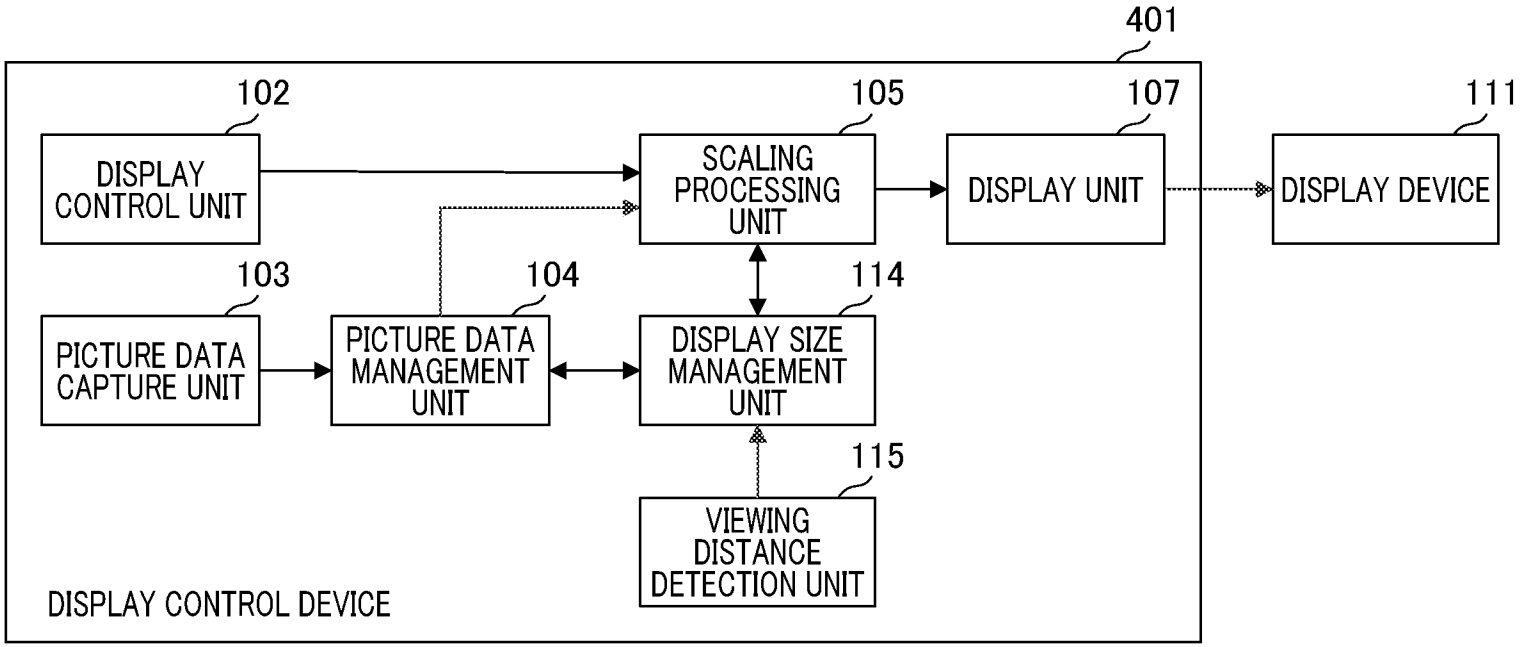
FIG. 8 is a diagram illustrating the configuration of a display control device according to a third embodiment.

FIG. 8 is a diagram illustrating the configuration of a display control device of a third embodiment. A display control device 401 includes the display control unit 102, the picture data capture unit 103, the picture data management unit 104, the scaling processing unit 105, the display unit 107, the display size management unit 114, and a viewing distance detection unit 115. Among the processing units included in the display control device 401, the processing units designated by the same reference numerals as the processing units included in the display control device 301 shown in FIG. 6 are the same as the processing units included in the display control device 301.

The viewing distance detection unit 115 detects a distance between the display device 111 and a viewer who views a picture as a viewing distance. Although the viewing distance detection unit 115 measures a viewing distance using an occupancy sensor such as infrared radiation, ultrasonic waves, or the like, the present invention is not limited thereto. The viewing distance detection unit 115 notifies the detected viewing distance to the display size management unit 114. In other words, the viewing distance detection unit 115 functions as a viewing distance input unit that detects a distance between the display device 111 and a viewer as a viewing distance and notifies the detected viewing distance to the display size management unit 114. Note that the viewing distance detection unit 115 may always detect a viewing distance or may detect a viewing distance at regular intervals.

The display size management unit 114 calculates a display size such that the relationship (ratio) between the picture size and the optimum viewing distance is equal to the relationship between the display size and the viewing distance using the viewing distance notified from the viewing distance detection unit 115. A display size calculation method is the same as the display size calculation method of the second embodiment.

Here, when the display size changes one after another due to changes in the viewing distance, a viewer may experience discomfort. Thus, the display size management unit 114 may calculate or change the display size only when the viewing distance changes equal to or larger than a predetermined value or only when the calculated display size changes equal to or larger than a predetermined value. Also, the display size management unit 114 may calculate or change the display size only when a predetermined period of time has been elapsed from the change in the previous display size.

Thus, the display control device of the third embodiment enables a viewer to view a picture displayed on a display device more like the way in which the viewer views an actual picture from the optimum viewing distance unique to the picture in accordance with any foot placement of the viewer.

(Fourth Embodiment)

Figure 9:
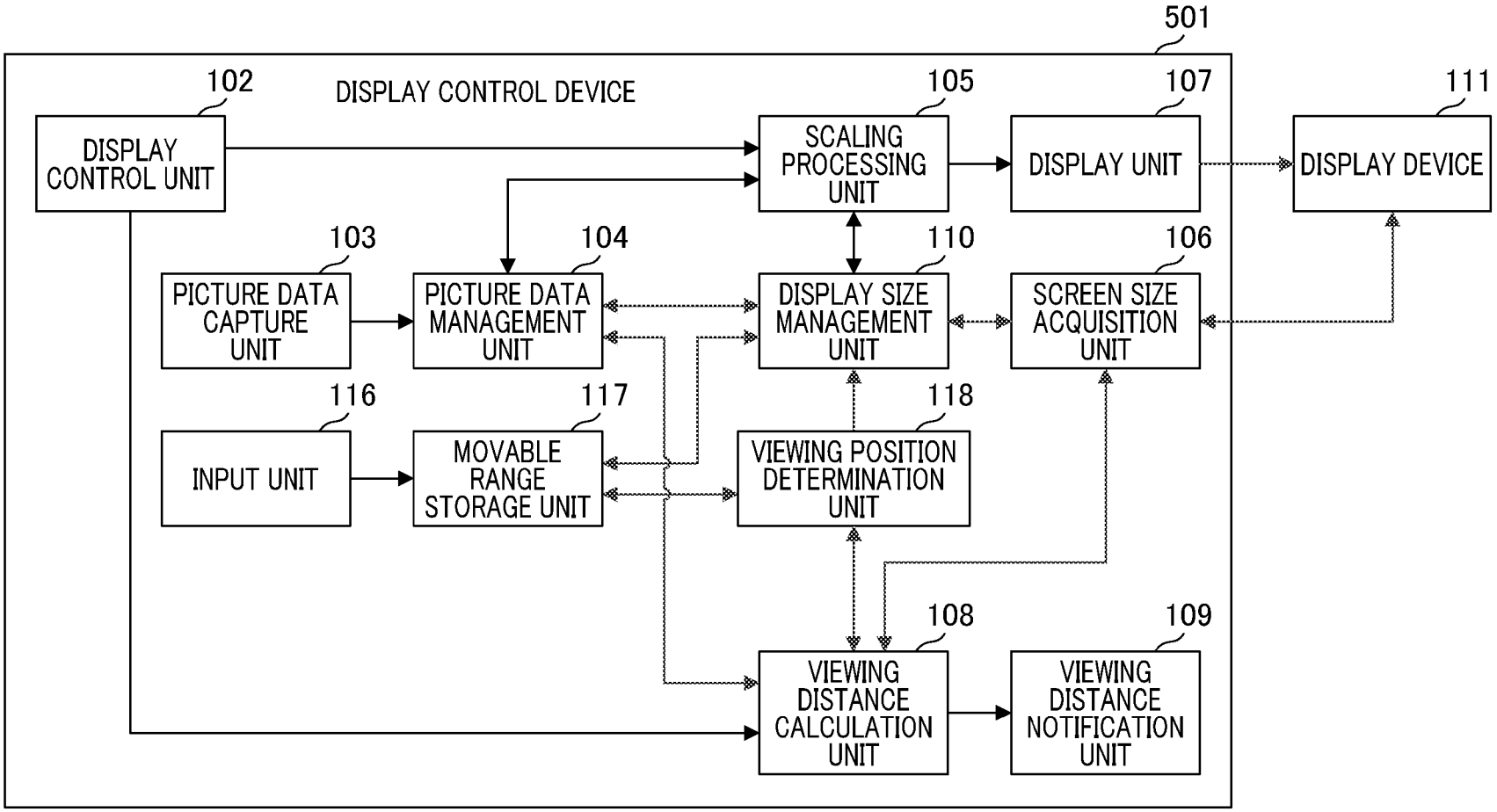
FIG. 9 is a diagram illustrating the configuration of a display control device according to a fourth embodiment.

FIG. 9 is a diagram illustrating the configuration of a display control device of a fourth embodiment. A display control device 501 includes the display control unit 102, the picture data capture unit 103, the picture data management unit 104, the scaling processing unit 105, and the screen size acquisition unit 106. Also, the display control device 101 includes the display unit 107, the viewing distance calculation unit 108, the viewing distance notification unit 109, and the display size management unit 110. Further, the display control device 101 includes an input unit 116, a movable range storage unit 117, and a viewing position determination unit 118. Among the processing units included in the display control device 501, the processing units designated by the same reference numerals as the processing units included in the display control device 101 shown in FIG. 1A are the same as the processing units included in the display control device 101.

The input unit 116 inputs a movable range in accordance with a user's operation. The movable range is a range in front of the display device 111, over which a viewer is movable upon viewing a picture displayed on the display device 111. In the present embodiment, the input unit 116 inputs the maximum movable distance, i.e., the maximum viewing distance, in the range in front of the display device 111 as the movable range. The movable range storage unit 117 stores and manages the movable range input by the input unit 116. In other words, the movable range storage unit 117 functions as a movable range management unit that manages the viewer's movable range in front of the display device.

In the present embodiment, the viewing distance calculation unit 108 calculates a recommended viewing distance using a screen size as in the first embodiment. The viewing position determination unit 118 acquires the recommended viewing distance, which has been calculated by the viewing distance calculation unit 108, from the viewing distance calculation unit 108. Also, the viewing position determination unit 118 acquires the movable range from the movable range storage unit 117. Then, the viewing position determination unit 118 functions as a determination unit that determines whether or not the recommended viewing distance falls within the movable range, that is, the recommended viewing distance does not exceed the maximum viewing distance.

When the viewing position determination unit 118 has determined that the recommended viewing distance does not fall within the movable range, the display size management unit 110 executes the following processing. The display size management unit 110 determines the maximum viewing distance, which has been input as the movable range, as a recommended viewing distance to be notified by the viewing distance notification unit 109. The viewing distance notification unit 109 notifies the determined recommended viewing distance to be notified.

Also, the display size management unit 110 calculates a display size such that the relationship between the picture size and the optimum viewing distance both acquired from the picture data management unit 104 is equal to the relationship between the recommended viewing distance to be notified and the display size. Then, the display size management unit 110 causes the display device 111 to display a picture in the calculated display size via the scaling processing unit 105 and the display unit 107.

When the viewing position determination unit 118 has determined that the recommended viewing distance falls within the movable range, the viewing distance calculation unit 108 notifies the recommended viewing distance to the viewing distance notification unit 109. Also, the display size management unit 110 passes the screen size as the display size to the scaling processing unit 105, and causes the scaling processing unit 105 to scale image data to the display size.

Figure 10:
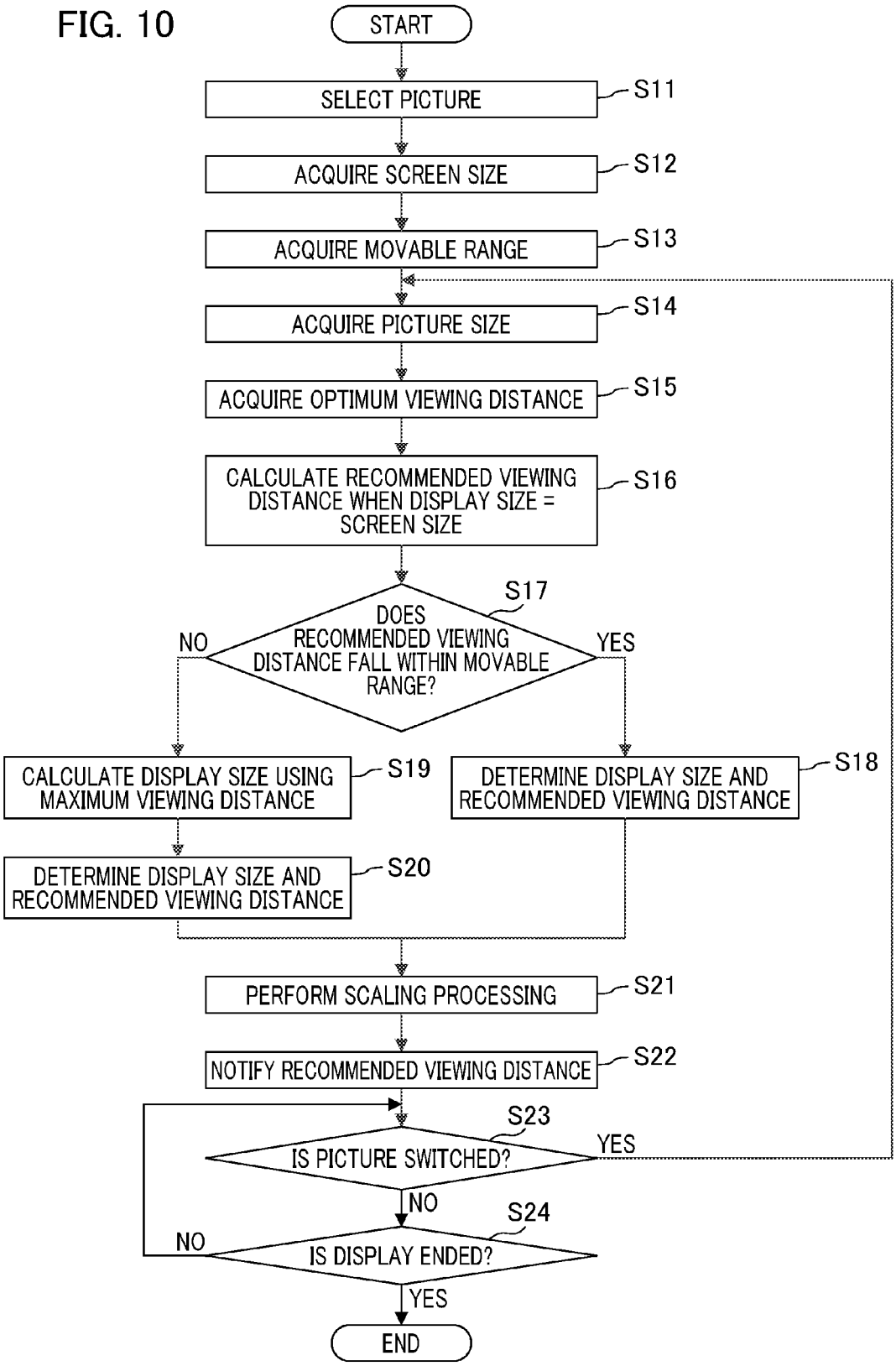
FIG. 10 is a diagram illustrating an example of operation processing performed by the display control device of the fourth embodiment.

FIG. 10 is a flowchart illustrating an example of operation processing performed by a display control device of a fourth embodiment. First, the display control unit 102 selects a picture to be displayed, and notifies the selected picture to the viewing distance calculation unit 108 (step S11).

Next, the viewing distance calculation unit 108 acquires the screen size of the display device 111 from the display size management unit 110 (step S12). Next, the viewing position determination unit 118 acquires the movable range from the movable range storage unit 117 (step S13).

The viewing distance calculation unit 108 acquires the picture size of the picture selected by the display control unit 102 from the picture data management unit 104 (step S14). Also, the viewing distance calculation unit 108 acquires the optimum viewing distance of the picture selected by the display control unit 102 from the picture data management unit 104 (step S15).

Next, as in the first embodiment, the viewing distance calculation unit 108 calculates the recommended viewing distance based on the picture size, the optimum viewing distance, and the screen size (step S16). The picture size calculated in step S16 is a recommended viewing distance obtained when the display size is set as the screen size. Next, the viewing position determination unit 118 determines whether or not the recommended viewing distance calculated in step S16 falls within the movable range (step S17). In this example, the viewing position determination unit 118 determines whether or not the recommended viewing distance exceeds the maximum viewing distance input as the movable range. When the recommended viewing distance does not exceed the maximum viewing distance, the viewing position determination unit 118 determines that the recommended viewing distance falls within the movable range. When the recommended viewing distance exceeds the maximum viewing distance, the viewing position determination unit 118 determines that the recommended viewing distance does not fall within the movable range.

When the recommended viewing distance falls within the movable range, a viewer can view the picture from the recommended viewing distance if the picture is displayed in the screen size (maximum display size) of the display device 111. Thus, in this case, the display size management unit 110 determines the recommended viewing distance calculated in step S16 as the recommended viewing distance to be notified (step S18). In step S18, the display size management unit 110 further determines the screen size as the display size.

When the recommended viewing distance does not fall within the movable range, a viewer cannot view the picture from the recommended viewing distance if the picture is displayed in the screen size (maximum display size) of the display device 111. In other words, when the display device 111 displays the picture in the maximum display size, a viewer cannot view the picture the way it is intended by the artist of picture data even if the viewer views the picture from the position corresponding to the recommended viewing distance.

In view of the above, the display size management unit 110 acquires the picture size and the optimum viewing distance from the picture data management unit 104. Also, the display size management unit 110 determines the maximum viewing distance, which has been input as the movable range, as the recommended viewing distance to be notified. Then, the display size management unit 110 calculates a display size such that the relationship between the picture size and the optimum viewing distance both acquired from the picture data management unit 104 is equal to the relationship between the maximum viewing distance and the display size (step S19). The display size management unit 110 determines the maximum viewing distance as the recommended viewing distance to be notified (step S20). In step S20, the display size management unit 110 further determines the display size to the display size calculated in step S19.

Next, the scaling processing unit 105 acquires image data of the picture specified by the display control unit 102 from the picture data management unit 104. Then, the scaling processing unit 105 executes scaling processing for image data in accordance with the display size determined in step S18 or step S20 (step S21). Also, the viewing distance notification unit 109 notifies the recommended viewing distance to be notified, which has been determined in step S18 or step S20, to a user (step S22). Step S23 and S24 are the same as steps S7 and S8 shown in FIG. 4.

A description will be given by taking an example in which recommended viewing distance calculation processing according to a fourth embodiment is applied to the picture A shown in FIG. 5A while the screen size MH in the longitudinal direction is 100 (cm) and the screen size MW in the transverse direction is 150 (cm).

In step S16 shown in FIG. 10, the display size management unit 110 calculates the recommended viewing distance RL as follows:

$$RL=(100/200)\times 400=200\ (\text{cm}).$$

Here, given that the maximum viewing distance input as the movable range is 120 (cm), the viewing position determination unit 118 determines in step S17 that the recommended viewing distance does not fall within the movable range.

Thus, the display size management unit 110 sets the viewing distance WL as the maximum viewing distance (120 (cm)) and calculates a display size using the viewing distance WL. More specifically, the display size management unit 110 calculates the display size MW in the transverse direction as follows using Formula 3:

$$MW=(120/400)\times 300=90\ (\text{cm})$$

Also, the display size management unit 110 calculates the display size MH in the longitudinal direction as follows using Formula 4:

$$MH=(120/400)\times 200=60\ (\text{cm})$$

When the recommended viewing distance calculated based on the screen size does not fall within the movable range, the display control device of the fourth embodiment calculates a display size such that the relationship between the picture size and the optimum viewing distance is equal to the relationship between the display size and the maximum viewing distance, and displays the picture in the calculated display size on the display device. Also, the display control device of the fourth embodiment notifies the maximum viewing distance as the recommended viewing distance to a user. Thus, the display control device of the fourth embodiment enables a viewer to view a picture displayed on a display device more like the way in which the viewer views an actual picture from the optimum viewing distance unique to the picture.

In the present embodiment, a description has been given by taking an example in which a display size is calculated using the maximum viewing distance input as the movable range when the recommended viewing distance does not fall within the movable range. As a variant of the present embodiment, the input unit 116 may set the maximum viewing distance as well as the minimum viewing distance in advance as the movable range. When the calculated recommended viewing distance is smaller than the minimum viewing distance, the display size management unit 110 calculates a display size while setting the minimum viewing distance as WL. Also, the viewing distance notification unit 109 notifies the minimum viewing distance to a user.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-038114 filed Feb. 24, 2011, which is hereby incorporated by reference herein in its entirety.

What is claimed is:

1. A display control device comprising:

an acquisition unit configured to acquire the size of a picture and a unique viewing distance unique to the picture, which are added in advance to picture data and stored in association with the picture, wherein the unique viewing distance is a predetermined optimum viewing distance unique to the picture;

a display size management unit configured to manage the display size of the picture displayed by a display device;

a viewing distance calculation unit configured to calculate a recommended viewing distance when a viewer views the picture displayed by the display device, wherein the recommended viewing distance is calculated based on the size of the picture acquired by the acquisition unit, the unique viewing distance acquired by the acquisition unit, and the display size of the picture managed by the display size management unit; and a notification unit configured to notify the recommended viewing distance, wherein the viewing distance calculation unit calculates a viewing distance, in which the relationship between the size of the picture and the unique viewing distance is substantially equal to the relationship between the display size and the viewing distance, as the recommended viewing distance.

2. The display control device according to claim 1, wherein the display size of the picture is the screen size of the display device.

3. The display control device according to claim 1, further comprising:

a movable range management unit configured to manage a movable range of the viewer in front of the display device; and a determination unit configured to determine whether or not the recommended viewing distance calculated by the viewing distance calculation unit falls within the movable range managed by the movable range management unit, wherein, when the determination unit has determined that the recommended viewing distance does not fall within the movable range, the display size management unit defines the maximum viewing distance corresponding to the movable range as a recommended viewing distance to be notified by the notification unit, calculates a display size in which the relationship between the size of the picture and the unique viewing distance is substantially equal to the relationship between the recommended viewing distance to be notified and the display size, and causes the display device to display the picture in the calculated display size.

4. A display control device comprising:

an acquisition unit configured to acquire the size of a picture and a unique viewing distance unique to the picture, which are added in advance to picture data and stored in association with the picture, wherein the unique viewing distance is a predetermined optimum viewing distance unique to the picture;

a viewing distance input unit configured to input a distance between a display device and a viewer who views the picture as a viewing distance; and a display size calculation unit configured to calculate the display size of the picture to be displayed by the display device, wherein the display size of the picture is calculated based on the size of the picture acquired by the acquisition unit, the unique viewing distance acquired by the acquisition unit, and the viewing distance input by the viewing distance input unit, wherein the display size calculation unit calculates a display size in which the relationship between the size of the picture and the unique viewing distance is substantially equal to the relationship between the input viewing distance and the display size.

5. The display control device according to claim 4, wherein the viewing distance input unit inputs a distance between a display device and a viewer who views the picture as a viewing distance in accordance with a user's operation input.

6. The display control device according to claim 4, wherein the viewing distance input unit detects a distance between a display device and a viewer who views the picture as a viewing distance using a sensor, and inputs the detected viewing distance.

7. A display control method comprising:

acquiring, in an acquisition step, the size of a picture and a unique viewing distance unique to the picture, which are added in advance to picture data and stored in association with the picture, wherein the unique viewing distance is a predetermined optimum viewing distance unique to the picture;

managing, in a display size management step, the display size of the picture displayed by a display device;

calculating, in a viewing distance calculation step, a recommended viewing distance when a viewer views the picture displayed by the display device based on the size of the picture acquired in the acquisition step, the unique viewing distance acquired in the acquisition step, and the display size of the picture managed in the display size management step; and notifying, in a notification step, the recommended viewing distance, wherein, in the viewing distance calculation step, calculating a viewing distance in which the relationship between the size of the picture and the unique viewing distance is substantially equal to the relationship between the display size and the viewing distance as the recommended viewing distance.

8. A display control method comprising:

acquiring, in an acquisition step, the size of a picture and a unique viewing distance unique to the picture, which are added in advance to picture data and stored in association with the picture, wherein the unique viewing distance is a predetermined optimum viewing distance unique to the picture;

inputting, in a viewing distance input step, a distance between a display device and a viewer who views the picture as a viewing distance; and calculating, in a display size calculation step, the display size of the picture displayed by the display device based on the size of the picture acquired in the acquisition step, the unique viewing distance acquired in the acquisition step, and the viewing distance input in the viewing distance input step, wherein, in the display size calculation step, calculating a display size in which the relationship between the size of the picture and the unique viewing distance is substantially equal to the relationship between the input viewing distance and the display size.

* * * * *